US010059126B2

(12) United States Patent
Ando

(10) Patent No.: US 10,059,126 B2
(45) Date of Patent: Aug. 28, 2018

(54) THERMAL PRINTER AND PORTABLE TERMINAL

(71) Applicant: Seiko Instruments Inc., Chiba-shi, Chiba (JP)

(72) Inventor: Norihisa Ando, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 0 days.

(21) Appl. No.: 15/493,524

(22) Filed: Apr. 21, 2017

(65) Prior Publication Data

US 2017/0305174 A1 Oct. 26, 2017

(30) Foreign Application Priority Data

Apr. 25, 2016 (JP) ..... 2016-087194
May 17, 2016 (JP) ..... 2016-098872

(51) Int. Cl.

| | |
|---|---|
| ***B41J 11/04*** | (2006.01) |
| ***B41J 2/32*** | (2006.01) |
| ***B41J 19/20*** | (2006.01) |
| *B41J 11/00* | (2006.01) |

(52) U.S. Cl.
CPC ..... *B41J 11/04* (2013.01); *B41J 2/32* (2013.01); *B41J 19/205* (2013.01); *B41J 11/004* (2013.01)

(58) Field of Classification Search
CPC ... B41J 11/04; B41J 11/004; B41J 2/32; B41J 19/205
USPC ..... 347/218
See application file for complete search history.

(56) References Cited

U.S. PATENT DOCUMENTS

2002/0020959 A1* 2/2002 Matsuda ..... B29C 45/26 271/122
2005/0095047 A1* 5/2005 Watanabe ..... B41J 2/32 400/55
2011/0142521 A1* 6/2011 Miyashita ..... B41J 11/04 400/283

(Continued)

FOREIGN PATENT DOCUMENTS

| | | | |
|---|---|---|---|
| EP | 1 338 423 | A2 | 8/2003 |
| JP | S61-224559 | A | 10/1986 |
| JP | 2013-006288 | A | 1/2013 |

OTHER PUBLICATIONS

Extended Search Report in corresponding European Application No. 17168063.0, dated Sep. 15, 2017, 7 pages.

*Primary Examiner* — Huan Tran
*Assistant Examiner* — Alexander D Shenderov
(74) *Attorney, Agent, or Firm* — Brinks Gilson & Lione

(57) ABSTRACT

A printer includes a platen roller configured to feed recording paper by nipping the recording paper with a thermal head; a frame which includes a shaft support portion configured to support the platen roller so that the platen roller is rotatable about an axis direction thereof; a drive source arranged on an inner side of the frame in the axial direction with respect to the shaft support portion; a planetary gear mechanism which is arranged on the inner side of the frame in the axial direction with respect to the shaft support portion and is configured to reduce power of the drive source; and a power transmission mechanism which is arranged on an outer side of the frame in the axial direction with respect to the shaft support portion and is configured to transmit power of the planetary gear mechanism to the platen roller.

12 Claims, 6 Drawing Sheets

(56) References Cited

U.S. PATENT DOCUMENTS

2012/0327167 A1 12/2012 Tsuchiya et al.
2014/0056618 A1* 2/2014 Matsuda ..... G03G 15/757
399/167

* cited by examiner

THERMAL PRINTER AND PORTABLE TERMINAL

RELATED APPLICATIONS

This application claims priority under 35 U.S.C. § 119 to Japanese Patent Applications No. 2016-087194 filed on Apr. 25, 2016 and No. 2016-098872 filed on May 17, 2016, the entire content of which is hereby incorporated by reference.

BACKGROUND OF THE INVENTION

1. Field of the Invention

The present invention relates to a thermal printer and a portable terminal.

2. Description of the Related Art

Hitherto, a thermal printer has been known as a printer configured to perform printing on a recording sheet (heat-sensitive paper). The thermal printer includes a thermal head, a platen roller, and a frame. The thermal head includes a heating element. The platen roller is configured to feed the recording paper by nipping the recording paper with the thermal head. The frame includes a shaft support portion which is configured to support the platen roller so that the platen roller is rotatable about an axis thereof. In the thermal printer, the heating element of the thermal head is caused to generate heat as appropriate during a course of feeding the recording paper through rotation of the platen roller, thereby being capable of printing various information on the recording paper.

The above-mentioned platen roller is rotated by transmission of power of a motor through intermediation of a speed reduction mechanism. The motor is arranged on an inner side of the frame in an axial direction with respect to the shaft support portion. Further, the speed reduction mechanism is arranged on an outer side of the frame in the axial direction with respect to the shaft support portion. The speed reduction mechanism includes a two-step gear, specifically, a gear which includes a large gear and a small gear having different numbers of teeth and being arrayed in the axial direction. The speed reduction mechanism is covered with a gear cover from the outer side in the axial direction.

Incidentally, particularly for a thermal printer which is to be mounted to a portable terminal such as a card payment terminal, downsizing in the axial direction, that is, in a width direction of recording paper has been demanded. The dimension of the thermal printer in the axial direction is determined based on the thicknesses of the shaft support portion, the speed reduction mechanism, and the gear cover, in addition to a width of recording paper to be used.

However, in the above-mentioned related-art thermal printer, there is difficulty in reduction of the thicknesses of the shaft support portion, the speed reduction mechanism, and the gear cover in consideration of durability, and hence there has been a limit in the downsizing in the axial direction. Therefore, the downsizing in the axial direction has been demanded for the thermal printer of this type.

SUMMARY OF THE INVENTION

According to one embodiment of the present invention, there is provided a thermal printer, including: a platen roller configured to feed recording paper by nipping the recording paper with a thermal head; a frame which includes a shaft support portion configured to support the platen roller so that the platen roller is rotatable about an axis direction thereof; a drive source arranged on an inner side of the frame in the axial direction with respect to the shaft support portion; a planetary gear mechanism which is arranged on the inner side of the frame in the axial direction with respect to the shaft support portion and is configured to reduce power of the drive source; and a power transmission mechanism which is arranged on an outer side of the frame in the axial direction with respect to the shaft support portion and is configured to transmit power of the planetary gear mechanism to the platen roller.

In the above-mentioned thermal printer according to the one embodiment of the present invention, wherein the planetary gear mechanism includes an output portion which protrudes toward an outer side of the frame in the axial direction with respect to the shaft support portion to be engaged with the power transmission mechanism, and wherein the power transmission mechanism has a thickness in the axial direction which is equal to or smaller than that of the output portion.

In the above-mentioned thermal printer according to the one embodiment of the present invention, wherein a driven gear is arranged at a portion of the platen roller which is located on an outer side in the axial direction with respect to the shaft support portion, wherein the power transmission mechanism includes an idler gear which connects the planetary gear mechanism and the driven gear to each other, and wherein the driven gear and the idler gear are each constructed by a one-step gear having a thickness direction in the axial direction.

In the above-mentioned thermal printer according to the one embodiment of the present invention, wherein the driven gear, the planetary gear mechanism, and the idler gear are each made of a resin material.

In the above-mentioned thermal printer according to the one embodiment of the present invention, wherein an outer shape of the planetary gear mechanism as viewed from the axial direction is set within an inner side of an outer shape of the drive source as viewed from the axial direction.

In the above-mentioned thermal printer according to the one embodiment of the present invention, wherein an outer shape of the planetary gear mechanism as viewed from the axial direction is set within an inner side of an outer shape of the drive source as viewed from the axial direction.

According to one embodiment of the present invention, there is provided a portable terminal, including: the above-mentioned thermal printer; and a casing to which the thermal printer is mounted.

DETAILED DESCRIPTION OF THE PREFERRED EMBODIMENTS

Figure 1:
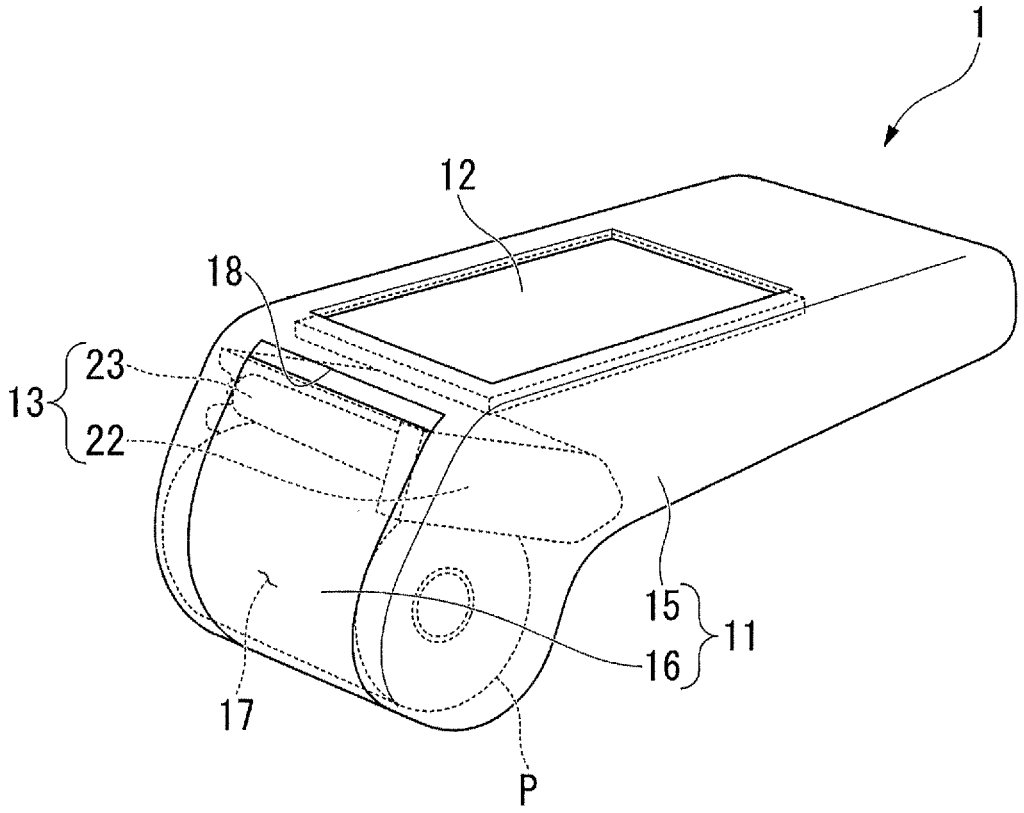
FIG. 1 is a perspective view of a portable terminal according to one embodiment of the present invention.

Now, embodiments of the present invention are described with reference to the accompanying drawings. FIG. 1 is a perspective view of a portable terminal 1. As illustrated in FIG. 1, the portable terminal 1 is, for example, a payment terminal which is portable by a user. The portable terminal 1 includes a casing 11, an input display portion 12, and a thermal printer 13.

The casing 11 includes a casing main body 15 and a printer cover 16. The casing main body 15 is formed into a box shape having a rectangular shape in plan view. In a distal end portion of the casing main body 15, there is formed a recording paper receiving portion 17 configured to receive recording paper P (thermal paper). The recording paper P is received, under a state of being wound into a roll, in the recording paper receiving portion 17. The printer cover 16 is turnably connected to the casing main body 15 through intermediation of a hinge portion (not shown). The printer cover 16 is configured to open and close the recording paper receiving portion 17. In the casing 11, there is formed a discharge port 18, which is configured to deliver the recording paper P to the outside, between an opening edge of the recording paper receiving portion 17 and a distal edge of the printer cover 16. The input display portion 12 is arranged on a front surface of the casing 11. The input display portion 12 is, for example, a touch panel. The input display portion 12 is configured to display various information on a screen and enable operation to the information displayed on the screen.

The thermal printer 13 is mounted at a position adjacent to the discharge port 18 in the casing 11. The thermal printer 13 is configured to print information with respect to the recording paper P, which is fed from the recording paper receiving portion 17, and to deliver the printed recording paper P through the discharge port 18.

Figure 2:
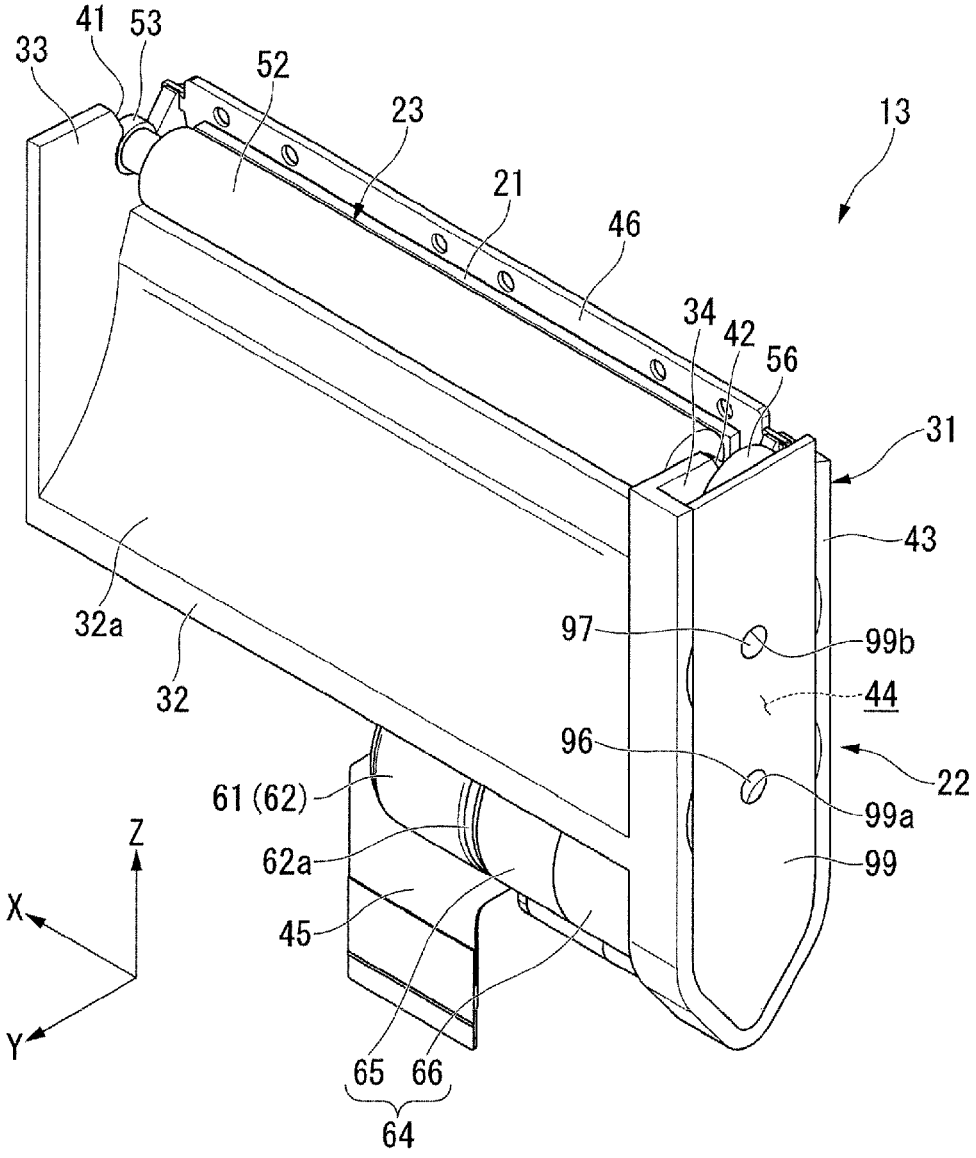
FIG. 2 is a perspective view of the thermal printer according to the embodiment.
Figure 3:
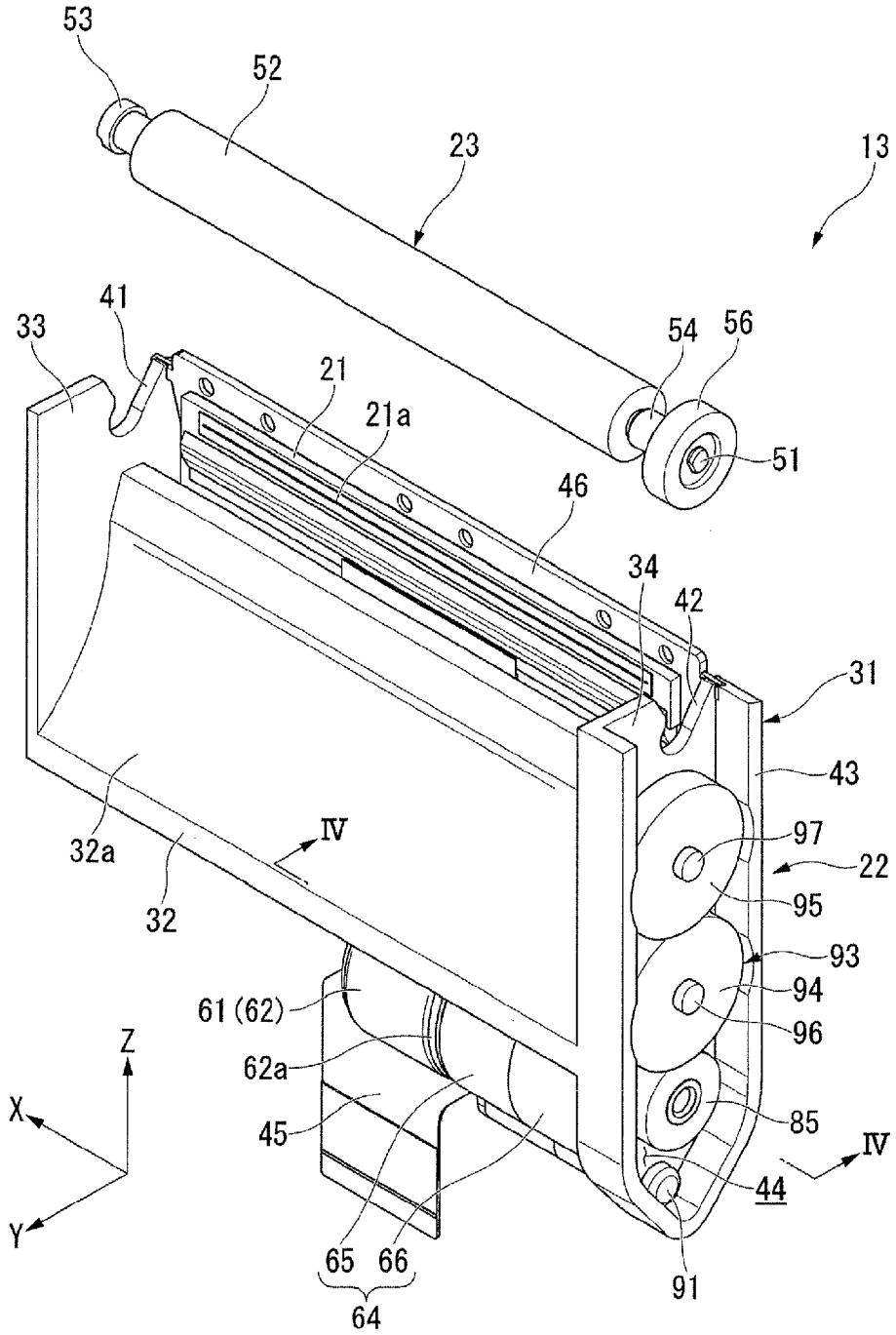
FIG. 3 is an exploded perspective view of the thermal printer according to the embodiment.

FIG. 2 is a perspective view of the thermal printer 13. FIG. 3 is an exploded perspective view of the thermal printer 13. As illustrated in FIG. 2 and FIG. 3, the thermal printer 13 includes a head unit 22 and a platen roller 23. The head unit 22 includes a thermal head 21. In the example illustrated in FIG. 1, the head unit 22 is assembled to the casing main body 15. The platen roller 23 is assembled to the printer cover 16 and is rotatably supported on the printer cover 16. The printer cover 16 has a shaft in the lower part of FIG. 1, and is opened by left-front side of FIG. 1. At that time, the platen roller 23 moves with the printer cover 16. Thereby, the platen roller 23 and the thermal head 21 (the part of head unit 22) are removed, and the recording paper becomes in a free state. Conversely, when the printer cover 16 is closed, the platen roller 23 follows with the printer cover 16. At that time, the platen roller 23 is located at the position contact with the thermal head 21. In this way, the head unit 22 and the platen roller 23 are combined so as to be separable along with opening and closing of the printer cover 16. When the printer cover 16 takes a closed position, the head unit 22 and the platen roller 23 are opposed to each other across the above-mentioned discharge port 18. In the following description, an axial direction of the platen roller 23 is described as an X direction, and two directions orthogonal to the X direction are described as a Y direction and a Z direction. Further, in the following description, in each of the X direction, the Y direction, and the Z direction, a direction indicated by the arrow in the drawings is described as a plus direction, and a direction opposite to the arrow is described as a minus direction.

As illustrated in FIG. 3, a frame 31 of the head unit 22 is formed into a U-shape which is opened in the plus Z direction in front view from the Y direction. Specifically, the frame 31 includes a base portion 32, a first shaft support portion 33, and a second shaft support portion 34. The base portion 32 extends in the X direction. The first shaft support portion 33 and the second shaft support portion 34 are connected to both end portions of the base portion 32 in the X direction. A surface of the base portion 32 which is oriented in the plus Y direction constructs a guide surface 32*a* which is configured to guide the recording paper P in the plus Z direction. The guide surface 32*a* is a curved surface which protrudes in the minus Y direction.

The first shaft support portion 33 is joined to the end portion of the base portion 32 in the plus X direction. The first shaft support portion 33 protrudes in the plus Z direction with respect to the base portion 32. At an end edge of the first shaft support portion in the minus Z direction, there is formed a first roller receiving groove 41 which is recessed in the minus Z direction. The second shaft support portion 34 is connected to the end portion of the base portion 32 in the minus X direction. The second shaft support portion 34 protrudes in both directions of the Z direction with respect to the base portion 32. At an end edge of the second shaft support portion 34 in the plus Z direction, there is formed a second roller receiving groove 42 which is recessed in the minus Z direction. In a portion of an outer peripheral edge of the second shaft support portion 34 other than the end edge in the plus Z direction, there is formed a peripheral wall portion 43 which stands in the minus X direction. A portion surrounded by the second shaft support portion 34 and the peripheral wall portion 43 constructs a gear box 44 which is opened in the minus X direction.

The thermal head 21 has a plate-like shape having a thickness direction in the Y direction and extending in the X direction. On a head surface of the thermal head 21, that is, a surface of the thermal head 21 which is oriented in the plus Y direction, a plurality of heating elements 21*a* are arrayed at intervals in the X direction. The thermal head 21 is connected to a controller (not shown) through a flexible board 45. A driver IC (not shown) mounted to the thermal head 21 controls heat generation of the heating element 21*a* in accordance with a signal from the controller, with the result that the thermal head 21 performs printing with respect to the recording paper P.

The thermal head 21 is fixed to a head support member 46. The head support member 46 is supported at portions of the shaft support portions 33 and 34 which are located in the minus Y direction with respect to the roller receiving grooves 41 and 42. The head support member 46 has a plate-like shape having a thickness direction in the Y direction and extending in the X direction. The thermal head 21 is bonded to a surface of the head support member 46 which is oriented in the plus Y direction. The head support member 46 is urged by an elastic member (not shown) in the minus Y direction to press the thermal head 21 against the platen roller 23 combined with the head unit 22.

The platen roller 23 nips the recording paper P with the thermal head 21 to convey the recording paper P toward the discharge port 18. Specifically, the platen roller 23 includes a platen shaft 51 and a roller main body 52. The platen shaft 51 extends in the X direction. At both end portions of the platen shaft 51 in the X direction, there are mounted a first bearing 53 and a second bearing 54, respectively. The bearings 53 and 54 are retained in the above-mentioned roller receiving grooves 41 and 42, respectively. With this, the platen roller 23 is supported on the frame 31 through intermediation of the shaft support portions 33 and 34 so as to be rotatable about an axis extending in the X direction and so as to be removable. At a portion of the platen shaft 51 which is located in the minus X direction with respect to the second bearing 54, there is arranged a driven gear 56. Under a state in which the platen roller 23 is retained in the roller receiving grooves 41 and 42, the driven gear 56 is positioned in the gear box 44, that is, in the minus X direction from the second shaft support portion 34. It is preferred that the driven gear 56 be made of a resin material.

The roller main body 52 is made of, for example, rubber. The roller main body 52 is externally mounted to a portion of the platen shaft 51 other than the both end portions of the platen shaft 51 in the X direction. An outer peripheral surface of the roller main body 52 is held in contact with the above-mentioned thermal head 21.

A motor 61 is arranged at a portion of the above-mentioned frame 31 which is located in the minus Z direction with respect to the base portion 32 and in the plus X direction with respect to the second shaft support portion 34. The motor 61 is arranged under a state in which a rotary shaft 61*a* (see FIG. 4) protrudes in the minus X direction. In a housing 62 for the motor 61, a flange portion 62*a* which projects toward an outer periphery is formed at an end portion in the minus X direction. The motor 61 is connected to the controller through, for example, the above-mentioned flexible board 45.

A speed reduction mechanism 64, which is configured to reduce the power of the motor 61, is arranged between the motor 61 and the second shaft support portion 34 in the X direction. The speed reduction mechanism 64 includes a first planetary gear mechanism 65 and a second planetary gear mechanism 66, which are arranged coaxially with the rotary shaft 61*a* of the motor 61.

Figure 4:
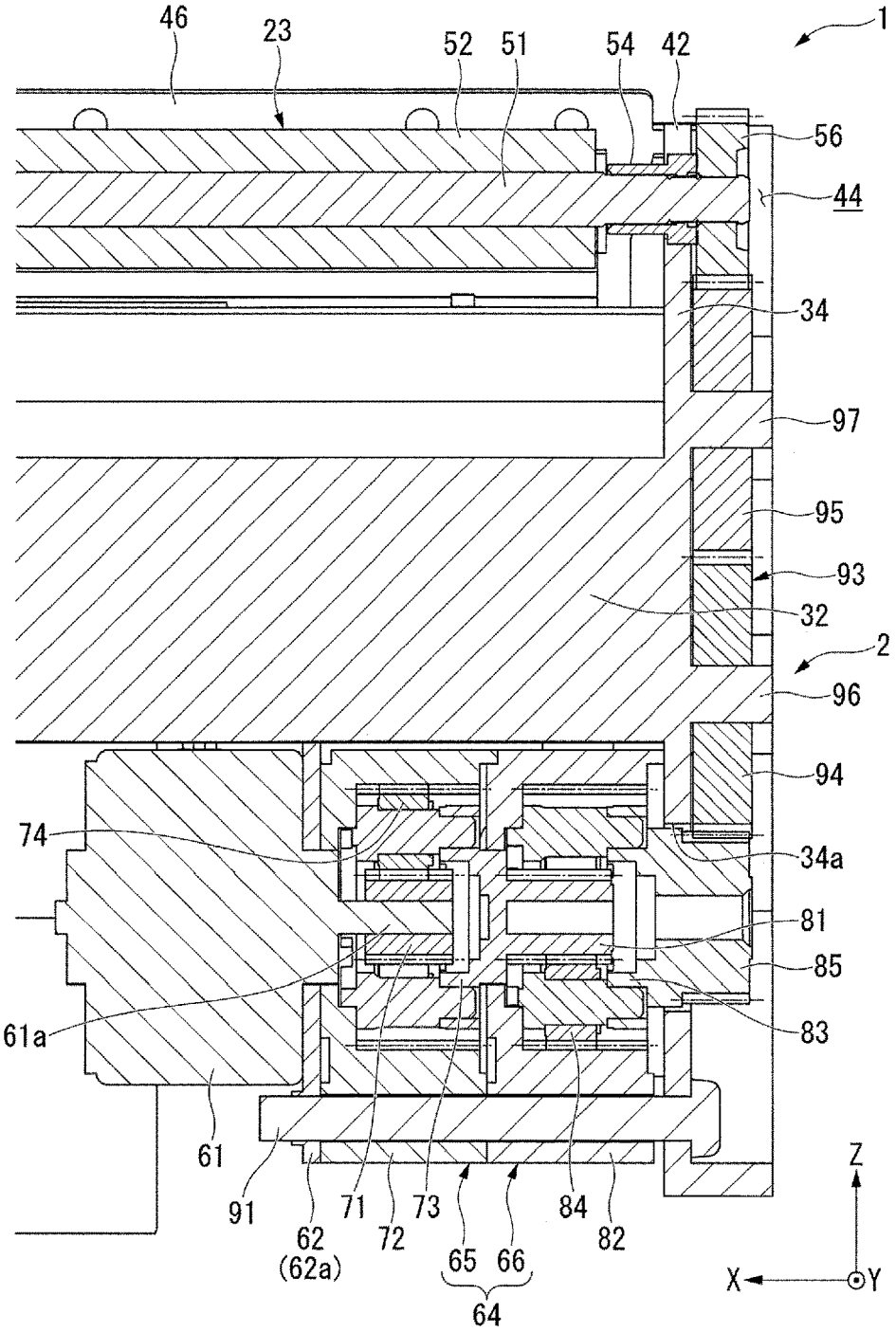
FIG. 4 is a sectional view taken along the line IV-IV of FIG. 3.

FIG. 4 is a sectional view taken along the line IV-IV of FIG. 3. As illustrated in FIG. 4, the first planetary gear mechanism 65 includes a first sun gear 71, a first ring gear 72, and a first carrier 73. The first sun gear 71 is press-fitted to the rotary shaft 61*a* of the motor 61 and rotates together with the rotary shaft 61*a*. The first ring gear 72 is arranged coaxially with the first sun gear 71 and surrounds the first sun gear 71. The first ring gear 72 is engaged with the flange portion 62*a* of the motor 61 in the X direction. The first carrier 73 supports a plurality of first planetary gears 74, which are arranged so as to be revolvable around the first sun gear 71, so that the plurality of first planetary gears 74 are rotatable about respective axes.

The second planetary gear mechanism 66 includes a second sun gear 81, a second ring gear 82, and a second carrier 83. The second sun gear 81 protrudes from the first carrier 73 in the minus X direction. The second ring gear 82 is arranged coaxially with the second sun gear 81 and surrounds the second sun gear 81. The second ring gear 82 is engaged with the first ring gear 72 in the X direction. The second carrier 83 supports a plurality of second planetary gears 84, which are arranged so as to be revolvable around the second sun gear 81, so that the plurality of second planetary gears 84 are rotatable on respective axes. The second carrier 83 has an output gear 85 which protrudes in the — direction of the X direction. The output gear 85 protrudes through a though hole 34*a*, which is formed in the second shaft support portion 34, into the gear box 44, that is, in the minus X direction with respect to the second shaft support portion 34.

The motor 61 and each of the planetary gear mechanisms 65 and 66 are fastened together to the second shaft support portion 34 by a fastening member 91 which penetrates through the flange portion 62*a* of the motor 61 and the ring gears 72 and 82 of the planetary gear mechanisms 65 and 66 in the X direction. That is, in the speed reduction mechanism 64 of this embodiment, the ring gears 72 and 82 are unrotatably fixed to the motor 61. In the illustrated example, one fastening member 91 is arranged at portions of the motor 61 and each of the planetary gear mechanisms 65 and 66 which are located in the minus Z direction. However, the configuration is not limited thereto. For example, the motor 61 and each of the planetary gear mechanisms 65 and 66 may be fixed to the second shaft support portion 34 with a plurality of fastening members 91. Further, the motor 61 and each of the planetary gear mechanisms 65 and 66 may be locked to the frame 31.

In this embodiment, an outer shape of each of the planetary gear mechanisms 65 and 66 in side view from the X direction is equivalent to an outer shape of the motor 61 in side view from the X direction. However, it is only necessary that the outer shape of each of the planetary gear mechanisms 65 and 66 in side view from the X direction be set within an inner side of the outer shape of the motor 61 in side view from the X direction. As long as a required reduction ratio can be obtained, the planetary gear mechanisms 65 and 66 may be replaced with one planetary gear mechanism or three or more planetary gear mechanisms. It is preferred that each gear of the planetary gear mechanisms 65 and 66 be made of a resin material.

In the above-mentioned gear box 44, there is accommodated a power transmission mechanism 93 configured to transmit power of the output gear 85 of the second planetary gear mechanism 66 to the driven gear 56 of the platen roller 23. The power transmission mechanism 93 includes a first idler gear 94 and a second idler gear 95. The first idler gear 94 is supported so as to be rotatable about a first rotary shaft 96 which protrudes from the second shaft support portion 34 in the minus X direction. The first idler gear 94 is a so-called one-step gear. Specifically, the first idler gear 94 is formed into a disc shape having a thickness direction in the X direction. On an outer circumferential surface of the first idler gear 94, there are formed a plurality of tooth portions, which extend along an entire length of the first idler gear 94 in the X direction, at intervals in a circumferential direction of the first idler gear 94. The tooth portions of the first idler gear 94 are in mesh with the above-mentioned output gear 85.

The second idler gear 95 is supported so as to be rotatable about a second rotary shaft 97 which protrudes from the second shaft support portion 34 in the minus X direction. The second idler gear 95 is the so-called one-step gear. Specifically, the second idler gear 95 is formed into a disc shape having a thickness direction in the X direction. On an outer circumferential surface of the second idler gear 95, there are formed a plurality of tooth portions, which extend along an entire length of the second idler gear 95 in the X direction, at intervals in a circumferential direction of the second idler gear 95. The tooth portions of the second idler gear 95 are in mesh with each of the above-mentioned first idler gear 94 and the driven gear 56. It is preferred that each of the idler gears 94 and 95 be made of a resin material. Further, it is preferred that the thickness of each of the idler gears 94 and 95 in the X direction be smaller than that of the above-mentioned output gear 85.

Figure 5:
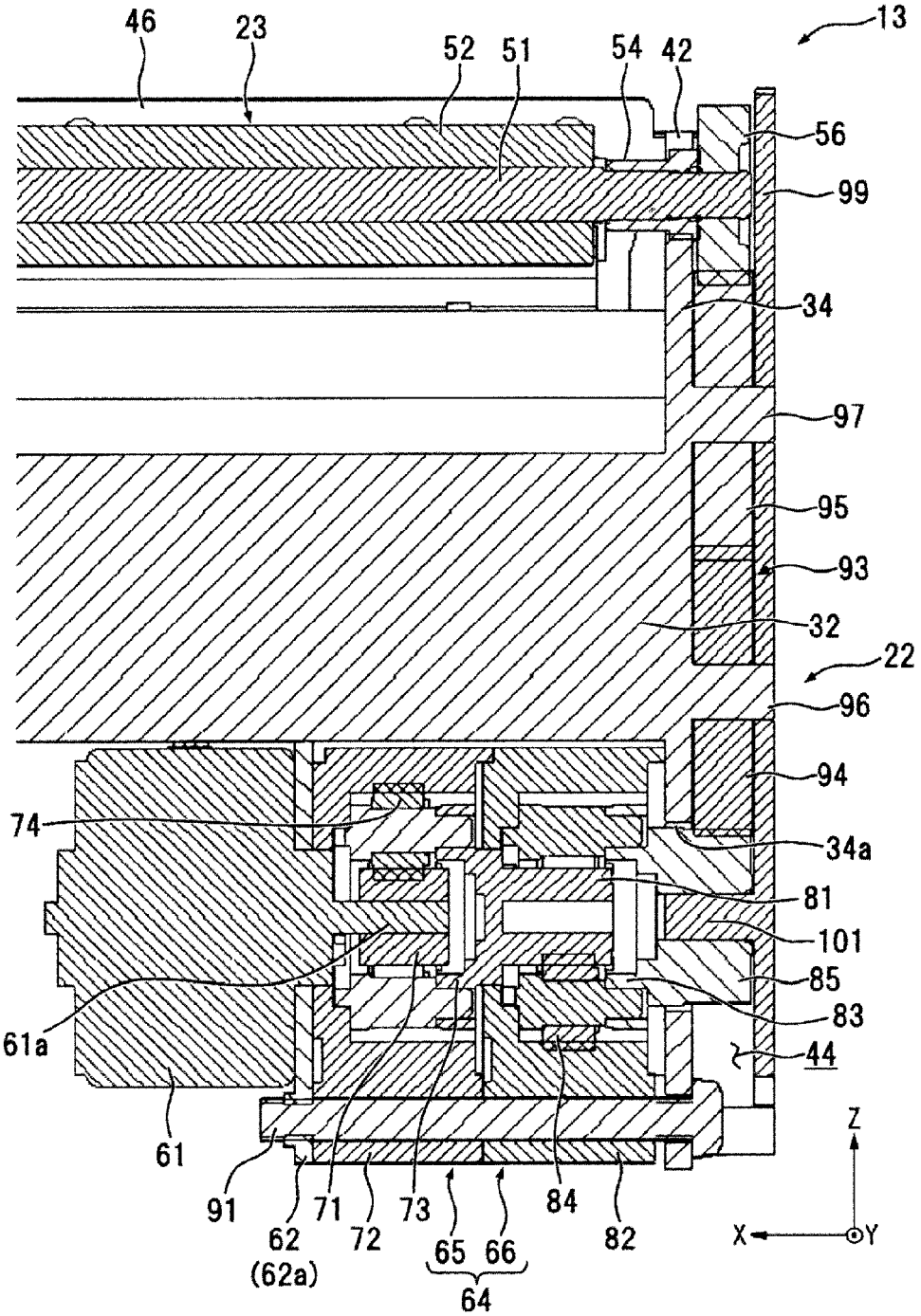
FIG. 5 is a sectional view of the thermal printer under a state in which a gear cover is mounted.

FIG. 5 is a sectional view of the thermal printer 13 under a state in which a gear cover 99 is mounted. As illustrated in FIG. 2 and FIG. 5, the gear box 44 is closed by the gear cover 99 from the minus X direction. In this case, end portions of the rotary shafts 96 and 97 in the minus X direction are respectively fitted into shaft support holes 99*a* and 99*b* formed in the gear cover 99.

Further, as illustrated in FIG. 5, the gear cover 99 has an output gear shaft 101 which protrudes from an inner surface of the gear cover 99 in the plus X direction. The second carrier 83 (output gear 85) of the second planetary gear mechanism 66 protrudes through the through hole 34*a*, which is formed in the second shaft support portion 34, into the gear box 44, that is, in the minus X direction with respect to the second shaft support portion 34 and is rotatably supported by the output gear shaft 101 formed on the gear cover 99.

Next, an operation method of the above-mentioned portable terminal 1 is described. In the following description, it is assumed that a distal end portion of the recording paper P is nipped between the platen roller 23 and the thermal head 21. In the portable terminal 1, printing with respect to the recording paper P is started through operation to the input display portion 12. Specifically, a signal is output from the controller to the motor 61 through, for example, the flexible board 45, with the result that the motor 61 rotates. When the motor 61 rotates, the first sun gear 71 of the first planetary gear mechanism 65 rotates. When the first sun gear 71 rotates, the first planetary gears 74 rotate about respective axes and revolve around the first sun gear 71, with the result that the first carrier 73 rotates together with the second sun gear 81. When the second sun gear 81 rotates, the second planetary gears 84 rotate about respective axes and revolve around the second sun gear 81, with the result that the second carrier 83 rotates together with the output gear 85. With this, the power of the motor 61 is reduced by the speed reduction mechanism 64.

Through rotation of each of the idler gears 94 and 95 along with rotation of the output gear 85, the power of the output gear 85 is transmitted to the driven gear 56. With this, the platen roller 23 rotates. The recording paper P nipped between the outer peripheral surface of the platen roller 23 and the thermal head 21 is delivered toward the discharge port 18.

When the signal is output from the controller to the thermal head 21 through the flexible board 45 during the course of delivering the recording paper P through rotation of the platen roller 23, the heating elements 21*a* of the thermal head 21 generate heat as appropriate. With this, various information is printed with respect to the recording paper P. Then, the recording paper P delivered through the discharge port 18 is cut and used as, for example, a receipt.

As described above, in this embodiment, the speed reduction mechanism 64, which is configured to reduce the power of the motor 61, is arranged in the plus X direction with respect to the second shaft support portion 34. With this configuration, the power of the motor 61 can be reduced through use of a space in the plus X direction with respect to the second shaft support portion 34. Therefore, unlike the related art, there is no need to provide a space for receiving the speed reduction mechanism such as the two-step gear in the minus X direction with respect to the second shaft support portion 34. That is, it is only necessary that the power transmission mechanism 93 of a thin type such as the idler gears 94 and 95 be arranged in the minus X direction with respect to the second shaft support portion 34, thereby being capable of reducing the dimension in the minus X direction with respect to the second shaft support portion 34, that is, the dimension of the gear box 44 in the X direction. As a result, the thermal printer 13 can be downsized in the X direction.

Incidentally, it is also conceivable to reduce the power of the motor 61 through use of, for example, the two-step gear in the plus X direction with respect to the second shaft support portion 34. In this case, in order to set the speed reduction mechanism within an inner side of the outer shape of the motor 61 in side view from the X direction, it is necessary to reduce the outer shape of the two-step gear in side view. As a result, in terms of abrasion and strength of the two-step gear, there may arise limitation in selection of material, such as the necessity to use a metal gear which is excellent in durability. Meanwhile, upsizing of the two-step gear or motor 61 may lead to upsizing of the thermal printer 13 in side view. Accordingly, in this embodiment, the planetary gear mechanisms 65 and 66 are used for the speed reduction mechanism 64. With this configuration, as compared with the case where the power of the motor 61 is reduced through use of, for example, the two-step gear in the plus X direction with respect to the second shaft support portion 34, downsizing and degree of freedom in design of the thermal printer 13 in side view from the X direction can be improved.

In this embodiment, the thickness of the power transmission mechanism 93 in the X direction is smaller than that of the output gear 85, thereby being capable of reliably downsizing the thermal printer 13 in the X direction. In this embodiment, the power transmission mechanism 93 is constructed by the idler gears 94 and 95, thereby being capable of securing transmission efficiency between the output gear 85 and the driven gear 56 while downsizing the thermal printer 13 in the X direction.

In this embodiment, the driven gear 56, the planetary gear mechanisms 65 and 66, and the idler gears 94 and 95 are made of a resin material, thereby being capable of suppressing noise during rotation as compared with the case where, for example, a metal gear is used.

In this embodiment, the outer shape of the planetary gear mechanisms 65 and 66 in side view is set within an inner side of the outer shape of the motor 61 in side view, thereby being capable of suppressing the upsizing of the thermal printer 13 in side view.

The portable terminal 1 of this embodiment includes the above-mentioned thermal printer 13, thereby being capable of providing the portable terminal 1 having a small size.

Note that, the technical scope of the present invention is not limited to the above-mentioned embodiment, but various modifications may be made without departing from the gist of the present invention.

In the above-mentioned embodiment, description is made of the configuration of using the one-step gear for the power transmission mechanism 93. However, not limited to this configuration, a belt or a chain may be used. In this case, pulleys are arranged at the platen shaft 51 of the platen roller 23 and at an output portion of the speed reduction mechanism 64, and the belt or the chain is stretched around the pulleys, thereby being capable of transmitting the power of the speed reduction mechanism 64 to the platen roller 23. That is, the power transmission mechanism 93 does not perform reduction of speed between the planetary gear mechanisms 65 and 66 and the driven gear 56, and appropriate modification can be made in the case of the configuration of the thin type.

In the above-mentioned embodiment, description is made of the case where two idler gears 94 and 95 are used for the power transmission mechanism 93. However, the configuration is not limited thereto. That is, the idler gears 94 and 95 may be replaced with one idler gear or three or more idler gears depending on, for example, a layout in the gear box 44 or the rotation direction of the platen roller 23. In the above-mentioned embodiment, description is made of the case where a payment terminal is used as one example of the portable terminal 1. However, not limited to this configuration, the configuration of the present invention may be applied to various types of portable terminals.

Figure 6:
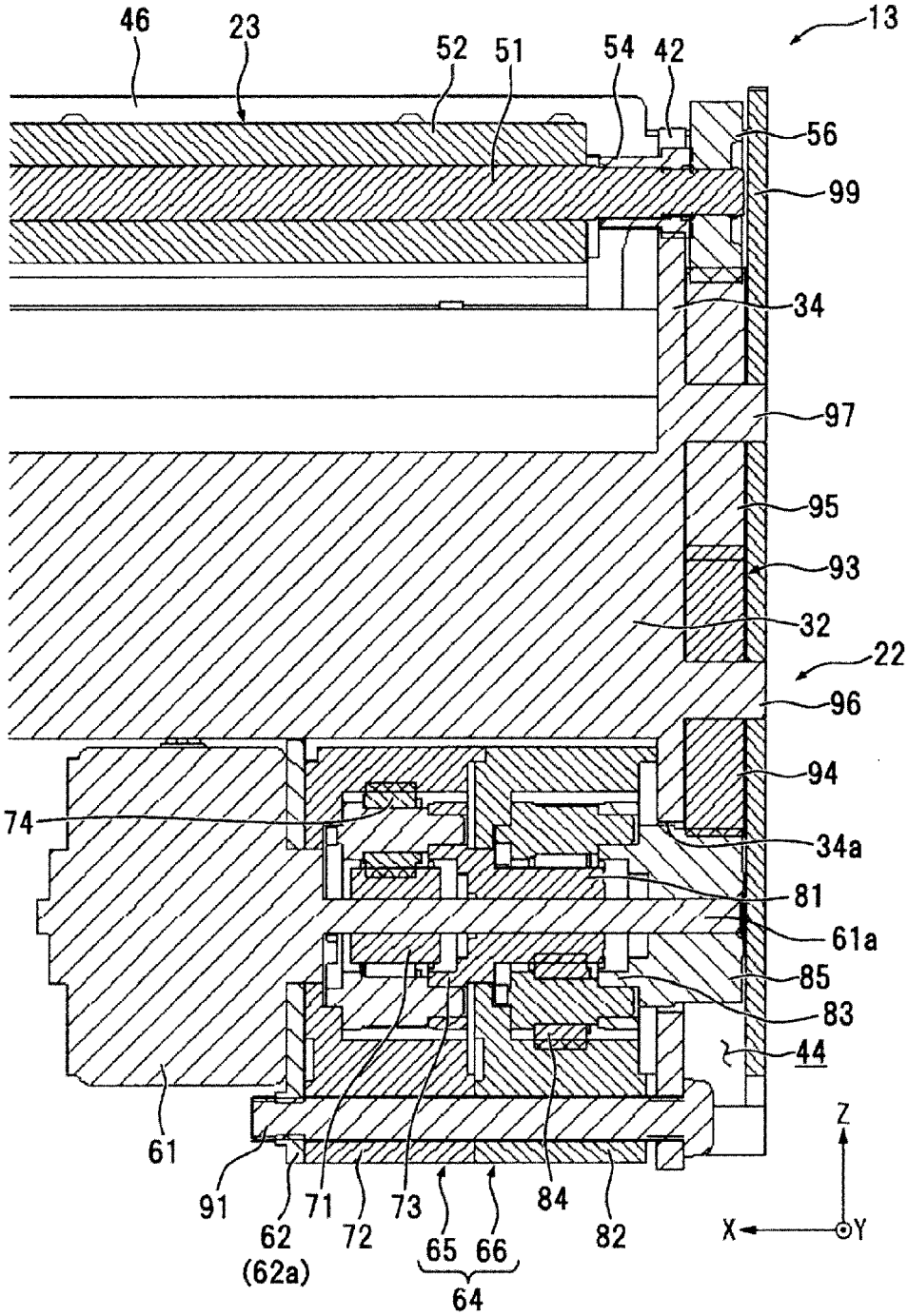
FIG. 6 is a sectional view of a thermal printer according to another embodiment of the present invention.

Next, another embodiment of the present invention is described. FIG. 6 is a sectional view of the thermal printer 13 according to another embodiment of the present invention. This embodiment is different from the above-mentioned embodiment in that the second sun gear 81 and the second carrier 83 (output gear 85) of the second planetary gear mechanism 66 are rotatably supported on the rotary shaft 61*a* of the motor 61.

As illustrated in FIG. 6, the rotary shaft 61*a* of the motor 61 extends in the minus X direction and passes through the first sun gear 71 of the first planetary gear mechanism 65 and the second sun gear 81 and the second carrier 83 (output gear 85) of the second planetary gear mechanism 66 to reach the gear cover 99. The first sun gear 71 is press-fitted to the rotary shaft 61*a* of the motor 61 and rotates together with the rotary shaft 61*a*. Meanwhile, the second sun gear 81 and the second carrier 83 (output gear 85) are rotatably supported on the rotary shaft 61*a* of the motor 61. That is, the second sun gear 81 and the second carrier 83 (output gear 85) are axially supported with respect to the rotary shaft 61*a* of the motor 61 so as to idly rotate through a slight gap, rather than being axially supported through the press-fitting.

As described above, in this embodiment, the rotary shaft 61*a*, which extends from the motor 61 to the gear cover 99 in the minus X direction, fixes the first sun gear 71 and rotatably supports the second sun gear 81 and the second carrier 83 (output gear 85). With this configuration, the second sun gear 81 and the second carrier 83 (output gear 85) are axially supported on the same shaft as the rotary shaft 61*a* to which the first sun gear 71 is press-fitted, thereby being capable of enhancing positional accuracy.

As in the embodiment illustrated in FIG. 5, when the second carrier 83 (output gear 85) is supported by the output gear shaft 101 which protrudes on the inner surface of the gear cover 99, the dimensional tolerance is increased due to increase in number of parts of the shaft, with the result that the positional accuracy is degraded. As a result, an inter-axial distance between the gears is not stabilized, and the transmission efficiency of the motor 61 is degraded. In contrast, according to this embodiment (FIG. 6), the first sun gear 71, the second sun gear 81, and the second carrier 83 (output gear 85) are fixed or supported on one rotary shaft 61*a*. Therefore, the inter-axial distance between the gears is stabilized, thereby being capable of improving the transmission efficiency of the motor 61.

Besides the above, the components in the above-mentioned embodiments may be replaced by well-known components as appropriate without departing from the gist of the present invention. The above-mentioned modified examples may be combined with each other as appropriate.

What is claimed is:

1. A thermal printer, comprising:

a platen roller configured to feed a recording paper by nipping the recording paper with a thermal head;

a frame that includes a shaft support portion configured to support the platen roller such that the platen roller rotates about an axis direction thereof;

a drive source on an inner side of the frame in the axial direction with respect to the shaft support portion;

a planetary gear mechanism on the inner side of the frame in the axial direction with respect to the shaft support portion and configured to reduce power of the drive source; and a power transmission mechanism on an outer side of the frame in the axial direction with respect to the shaft support portion and configured to transmit power of the planetary gear mechanism to the platen roller, wherein the planetary gear mechanism includes an output gear configured to transmit reduced power of the drive source to the power transmission mechanism, and wherein the output gear is supported on a rotary shaft of the drive source.

2. A thermal printer according to claim 1, wherein the planetary gear mechanism includes an output portion that protrudes toward an outer side of the frame in the axial direction with respect to the shaft support portion and engages with the power transmission mechanism, and wherein the power transmission mechanism has a thickness in the axial direction that is equal to or smaller than that of the output portion.

3. A thermal printer according to claim 2, wherein a driven gear is attached to a portion of the platen roller that is located on an outer side in the axial direction with respect to the shaft support portion, wherein the power transmission mechanism includes an idler gear that connects the planetary gear mechanism and the driven gear to each other, and wherein the driven gear and the idler gear each comprise a one-step gear having a thickness direction in the axial direction.

4. A thermal printer according to claim 3, wherein the driven gear, the planetary gear mechanism, and the idler gear are each made of a resin material.

5. A thermal printer according to claim 4, wherein an outer shape of the planetary gear mechanism, as viewed from the axial direction, is set within an inner side of an outer shape of the drive source, as viewed from the axial direction.

6. A thermal printer according to claim 5, wherein the output gear is configured to transmit the reduced power of the drive source to the idler gear.

7. A portable terminal, comprising:

the thermal printer of claim 6; and a casing to which the thermal printer is mounted.

8. A thermal printer according to claim 3, wherein the planetary gear mechanism includes an output gear that is configured to transmit reduced power of the drive source to the idler gear, and wherein the output gear is supported on a rotary shaft of the drive source.

9. A thermal printer according to claim 1, wherein a driven gear is attached to a portion of the platen roller located on an outer side in the axial direction with respect to the shaft support portion, wherein the power transmission mechanism includes an idler gear that connects the planetary gear mechanism and the driven gear to each other, and wherein the driven gear and the idler gear each comprise a one-step gear having a thickness direction in the axial direction.

10. A thermal printer according to claim 9, wherein the driven gear, the planetary gear mechanism, and the idler gear are each made of a resin material.

11. A thermal printer according to claim 1, wherein an outer shape of the planetary gear mechanism, as viewed from the axial direction, is set within an inner side of an outer shape of the drive source, as viewed from the axial direction.

12. A portable terminal, comprising:

the thermal printer of claim 1; and a casing to which the thermal printer is mounted.

* * * * *